US007407404B2

(12) United States Patent
Reid

(10) Patent No.: US 7,407,404 B2
(45) Date of Patent: Aug. 5, 2008

(54) DOUBLE MALE TWO-PRONG ELECTRICAL CONNECTOR APPARATUS

(76) Inventor: Georgianna Reid, 103 E. Meyer Blvd., Kansas City, MO (US) 64113

( * ) Notice: Subject to any disclaimer, the term of this patent is extended or adjusted under 35 U.S.C. 154(b) by 0 days.

(21) Appl. No.: 11/103,843

(22) Filed: Apr. 12, 2005

(65) Prior Publication Data

US 2005/0176266 A1 Aug. 11, 2005

Related U.S. Application Data

(60) Division of application No. 10/798,123, filed on Mar. 11, 2004, now Pat. No. 7,029,312, which is a continuation-in-part of application No. 10/418,345, filed on Apr. 18, 2003, now abandoned.

(51) Int. Cl.
*H01R 13/62* (2006.01)

(52) U.S. Cl. ..... 439/367

(58) Field of Classification Search ..... 439/367, 439/369; 174/68.1, 68.3
See application file for complete search history.

(56) References Cited

U.S. PATENT DOCUMENTS

| | | | | |
|---|---|---|---|---|
| 2,464,278 | A | 3/1949 | Wilson | |
| 3,068,316 | A | 12/1962 | Witt | |
| 3,408,616 | A | 10/1968 | Greenbaum | |
| 3,466,453 | A | 9/1969 | Greenberg | |
| 3,601,757 | A * | 8/1971 | Gober | 439/147 |
| 3,609,639 | A * | 9/1971 | Lind | 439/367 |
| 4,083,621 | A | 4/1978 | Davidson et al. | |
| 4,939,778 | A | 7/1990 | Tomberlin | |
| 5,118,301 | A | 6/1992 | Bentivolio | |
| 5,236,374 | A | 8/1993 | Leonard et al. | |
| 5,299,951 | A * | 4/1994 | Blaetz | 439/367 |
| 5,306,176 | A * | 4/1994 | Coffey | 439/367 |
| 5,395,264 | A | 3/1995 | Keith | |
| 5,397,243 | A * | 3/1995 | MacMurdo, Sr. | 439/447 |
| 5,399,102 | A | 3/1995 | Devine | |
| 5,462,452 | A | 10/1995 | Devine | |
| D374,174 | S | 10/1996 | McClellan | |
| D376,979 | S | 12/1996 | Davidson, III | |
| 5,619,569 | A | 4/1997 | McVay | |
| 5,704,400 | A | 1/1998 | Eldridge | |
| 5,762,515 | A * | 6/1998 | Mele | 439/367 |
| 5,823,817 | A | 10/1998 | Pyle | |

(Continued)

*Primary Examiner*—Briggitte R Hammond
(74) *Attorney, Agent, or Firm*—John C. McMahon

(57) ABSTRACT

A double male electrical connector is provided to connect the female end of a string of Christmas lights with the female end of an extension cord suitable for plugging into a wall outlet. The inventive connector is particularly useful when Christmas lights are wrapped from the wrong direction so that after wrapping the lights the female end is loose. The connector includes a conventional conductive cord with a first end and a second end. The first end has a first male plug and the second end has a second male plug. Each male plug has a first lead and a second lead for plugging into a two-prong receptacle. In accordance with the invention there is no third grounding lead. In an alternative embodiment the connector has a safety cap on at least one of the male plugs for safety, i.e., when the connector is not in use.

In the preferred embodiment the apparatus includes a jacket receiving the connector for axially slidable use so that both male plugs cannot both be simultaneously exposed.

10 Claims, 4 Drawing Sheets

U.S. PATENT DOCUMENTS

| | | | |
|---|---|---|---|
| 5,855,494 | A | 1/1999 | Blaszczyk et al. |
| 6,042,418 | A | 3/2000 | Cummings |
| 6,155,883 | A | 12/2000 | Chiu et al. |
| 6,190,199 | B1 | 2/2001 | Bump et al. |
| 6,328,597 | B1 | 12/2001 | Epps |
| 6,390,645 | B1 | 5/2002 | Wu |
| 6,408,616 | B1 | 6/2002 | Mazur et al. |
| 6,422,891 | B1 * | 7/2002 | Huang ..... 439/367 |
| 6,425,165 | B2 | 7/2002 | Koppang |
| 6,478,157 | B1 | 11/2002 | Witt |
| D466,867 | S | 12/2002 | Krobusek |
| D479,826 | S | 9/2003 | Verfuerth et al. |

* cited by examiner

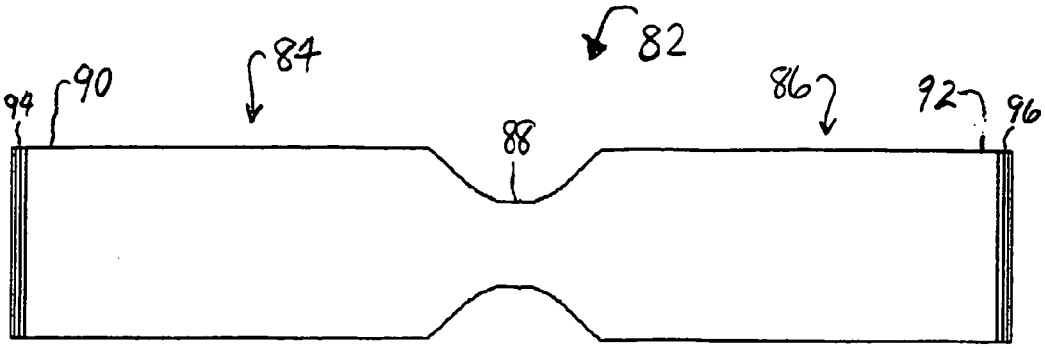
Fig. 7 a
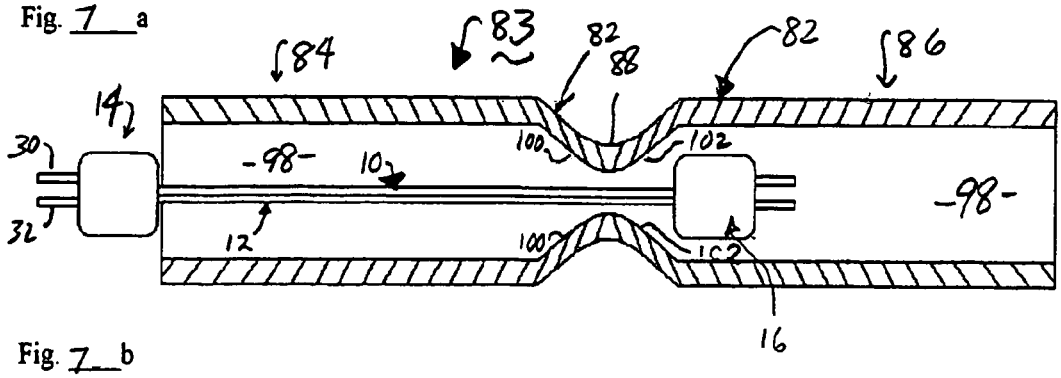
Fig. 7 b
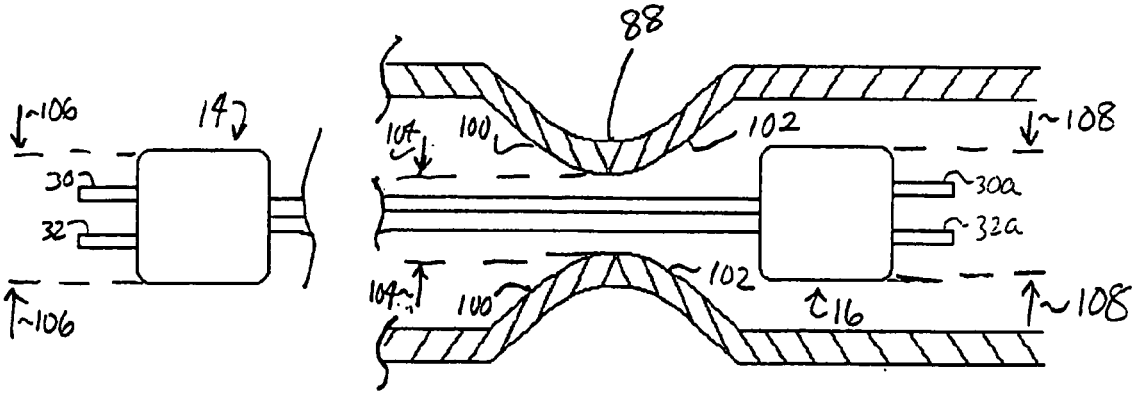
Fig. 7 c
Fig. 7d
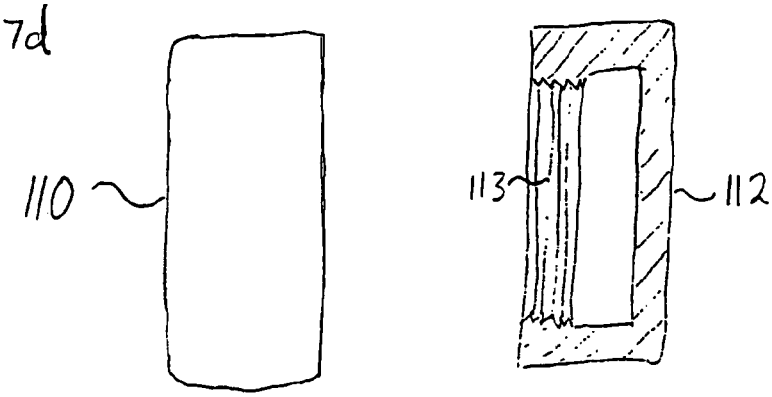

DOUBLE MALE TWO-PRONG ELECTRICAL CONNECTOR APPARATUS

CROSS-REFERENCE TO RELATED APPLICATION

This is a division of application Ser. No. 10/798,123, filed Mar. 11, 2004 now U.S. Pat. No. 7,029,312, which is a continuation-in-part of application Ser. No. 10/418,345, filed Apr. 18, 2003, now abandoned.

BACKGROUND OF THE INVENTION

1. Field of the Invention

This invention relates to electrical cords. More particularly, the invention is directed to a cord with a male plug at either end, each plug having only two prongs.

2. Description of the Prior Art

A string of small decorative lights is a very common article for holidays, festivals, parties and other celebrations. Particularly popular are Christmas tree lights, a typical string measuring perhaps ten feet in length and used to be wrapped around a Christmas tree or other accommodating structure. Oftentimes, several strings will be connected together and hung outdoors on a house or other structure, such as a group of trees. Typically, such a string of lights will have a two-pronged male end (Christmas tree lights normally have no third grounding prong) and a female end suitable for insertion of a two-pronged male from another electrical connector, such as an extension cord or another string of lights. In other words, Christmas tree lights and other similar strings of lights are intended to be wrapped beginning with the male end. Once all of the wrapping has been completed a small portion of cord including the female end will be left loose. In this way the female end of the light string can be connected to the male end of an extension cord so that in turn the male end of the extension cord may be connected to on-line power, typically by plugging into a wall outlet.

The problem with this situation is that a person who is putting up decorative lights may not notice as he begins to hang them that he should start with the male end. This situation occurs rather frequently since holiday lights hangers are often distracted or in a festive, carefree mood or perhaps have indulged in holiday libation so at the end of the wrapping process the user is left with only a female plug for use because the male end is, for example, completely wrapped and located at the top of the Christmas tree. In other words, only a female end is practically available and so the user, regardless of how many conventional Christmas light strings or extension cords he connects, he will not be able to plug into a wall outlet.

Perhaps he was intending to attach another string of lights to the first hung string. He may then insert the male end of the second set of lights into the female end of the first set. But this will not solve his problem which originated when he began by hanging the string of lights with the male end first, because when all his wrapping is done he will still have only a female end for further connection.

Ultimately he is left with a female end which must be connected to a wall outlet. A common extension cord, having a male end and a female end, will not serve this purpose, as noted above. What is needed, but commercially unavailable, is a connector which can join the female end of the miswrapped Christmas lights to the female end of either another string of lights, extension cord or other appropriate electrical connection. Because there has been no solution to this problem, no article available for purchase, the unfortunate consumer has heretofore had no alternative but to undo all the stringing of lights he has done, sometimes representing hours of wasted labor.

The solution to this problem must also avoid three-prong structures since small decorative lights are typically ungrounded. Double male three-prong electrical connectors are commercially available, but the double male two-prong connector in accordance with the present invention is not commercially available and yet is the only practical solution to this problem. In addition, a device is needed which provides two male plugs, but is configured so that only one plug is accessible at a time. In that way, the device can be used safely by adults but does not pose a threat to children or pets who might innocently touch the "hot" plug after the other has been electrically connected. At least one manufacturer heretofore has tried to solve this safety issue without success.

SUMMARY OF THE INVENTION

The present invention solves the foregoing problems by providing a double male electrical connector apparatus which allows an improperly wrapped string of Christmas lights to be connected to the female end of an extension cord or another female receptor which eventually leads to on-line power. The invention not only solves the need for two ungrounded male prongs back-to-back but does it in a safe way which avoids injury to pets or children.

The connector includes a conventional conductive cord with a first and a second end. The first end has a first male plug and the second end has a second male plug. Each male plug has a first lead and a second lead for plugging into a two-prong receptacle. In accordance with the invention there is no third grounding lead. In an alternative embodiment the connector has a safety cap on at least one of the male plugs for safety, i.e., when the connector is not in use. In the preferred embodiment the apparatus includes a jacket receiving the connector for axially slidable use so that both male plugs cannot both be simultaneously exposed.

BRIEF DESCRIPTION OF THE DRAWINGS

FIG. 5 depicts the inventive connector with safety caps locked on;

FIG. 7*a* is a side view of a jacket used in accordance with the invention;

FIG. 7*b* is a partially sectional view of an electrical connector apparatus in accordance with the present invention;

FIG. 7*c* is an enlarged representation of FIG. 7*b* with certain portions omitted for ease of illustration; and FIG. 7*d* is a side view of two covers (one sectional) used in conjunction with the jacket of FIG. 7*a.*

DETAILED DESCRIPTION OF THE PREFERRED EMBODIMENT

Figure 1:
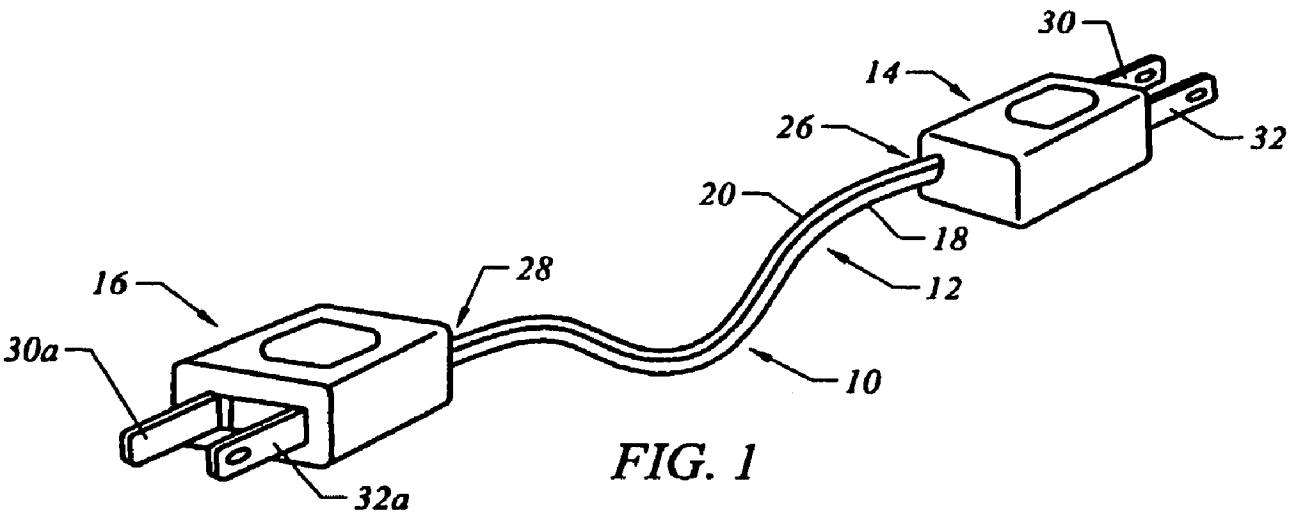
FIG. 1 is a perspective view of a double male two-prong electrical connector in accordance with the invention.

Referring to the figures in general and FIG. 1 in particular, a double male two-prong electrical connector 10 is shown in accordance with the invention. Connector 10 includes a cord 12, a first male plug 14, and a second male plug 16.

Figure 4C:
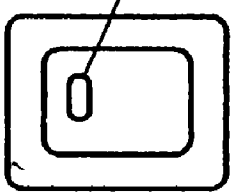
FIG. 4*c* is the opposite end of the housing from that of 4*a;*
Figure 4B:
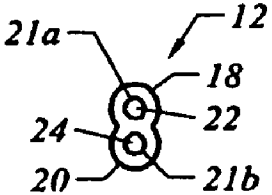
FIG. 4*b* is an end view of the cord.

Cord 12 includes an electrically insulative, hollow first channel member 18 and an electrically insulative, hollow second channel member 20. First channel member 18 includes portions forming a first channel 21*a* and second channel member 20 includes portions forming a second channel 21*b* (See FIG. 4*b*). First channel 18 member houses a first conductor 22 (see FIG. 4*b*) and a second conductor 24 (see FIG. 4*b*). In the preferred embodiment, conductors 22 and 24 are conventional wires such as used in lamp cords. Cord 12 includes a first end 26 and a second end 28.

Figure 3:
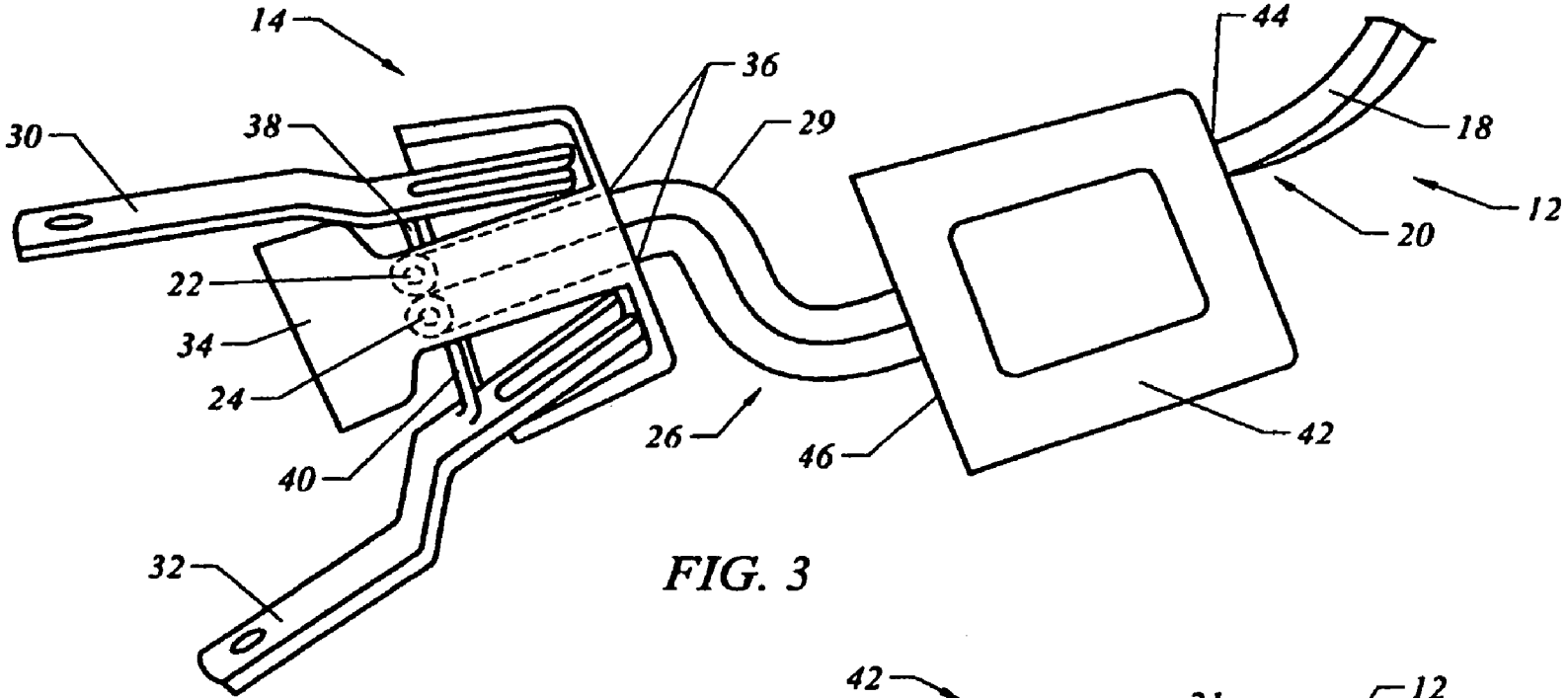
FIG. 3 is a disassembled side view of one male plug and one end of the cord.

Referring to FIG. 3, first end 26 of cord 12 is shown in more detail along with an enlarged, partially disassembled view of first plug 14. In particular, a crimped-necked portion 29 of first end 26 of cord 12 is shown. In the preferred embodiment cord 12 is about five inches long.

Figure 4A:
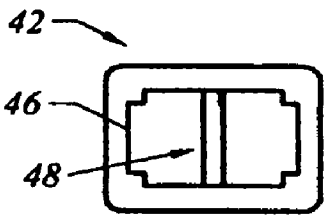
FIG. 4*a* is an end view of one end of the housing of a male plug.

Still referring to FIG. 3, first plug 14 includes a first lead or prong 30 and a second lead or prong 32. Both first lead 30 and second lead 32 are conventional electric conductors suitable for plugging into the female end of a convention string of Christmas lights, extension cord or other conventional female socket. First lead 30 and second lead 32 are housed and electrically insulated from each other by a substrate 34 which includes portions forming a hole 36 for receiving the very tip of first end 26 of cord 12 as shown in with dotted lines. First lead 30 includes a first peg 38 (partially shown) and second lead 32 has a second peg 40. First peg 38 is received within substrate 34, and penetrates first channel 18 so as to be in electrical communication with first conductor 22. First lead 30 is shown in the engaged position, i.e., abutting substrate 34, while second lead 32 is shown in a flexed position so that it is ajar from substrate 34. Because first lead 30 is in an engaged position, as shown, first peg 38 is received in a chamber (formed within substrate 34 but in spatial communication with the exterior thereof and not shown for clarity of illustration). First peg 38 penetrates first channel 18 so as to make electrical contact with first conductor 22. First plug 14 also includes a plug housing 42 having an aperture 44, a mouth 46 an dan invagination 48 formed in the interior of the housing 42 (see FIG. 4*a*). It will be noted that lead 30 flares out slightly as it extends from substrate 34 in the engaged position as shown. It will also be observed by casual inspection that second lead 32 (including second peg 40) is depicted in an unengaged position so that second peg 40 is not in electrical communication with second conductor 24.

In the preferred embodiment second plug 16 has an identical form and function but is not shown in FIG. 3 for ease of illustration.

Figure 2B:
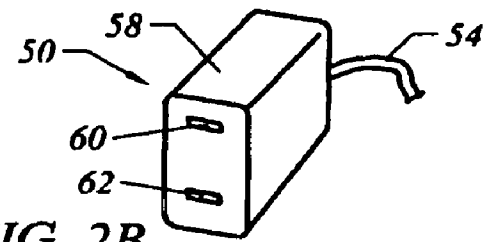
FIG. 2*b* is a partial perspective view of a cord and female end of the light string shown in FIG. 2*a;*
Figure 2A:
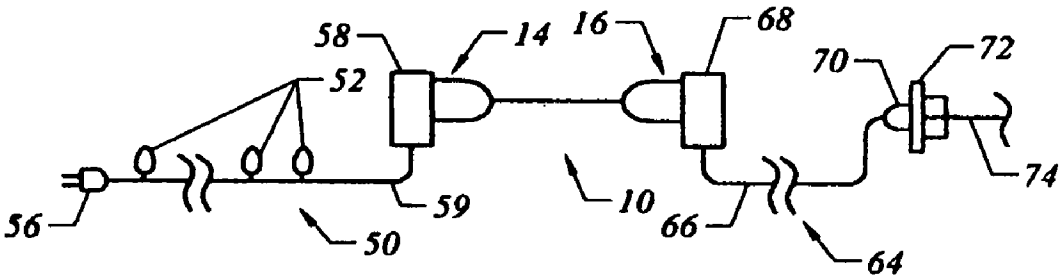
FIG. 2*a* is a partially schematic depiction of the inventive two-prong connector coupling the female end of a string of Christmas lights to the female end of an extension cord which is in turn plugged into a wall outlet.

Referring to FIG. 2*a,* double male connector 10 is shown partially schematically in operative association with a light string 50 featuring a plurality of decorative lights 52, string cord 54 and a male end 56.

String 50 also includes female end 58 which is shown in more detail in FIG. 2*b.* In particular, as shown in FIG. 2*b,* female end 58 includes a first lead receptor 60 and a second lead receptor 62.

Referring once again to FIG. 2*a,* an extension cord 64 is shown having a cord member 66, female end 68 and male end 70. Male end 70 of extension cord 64 is suitable for plugging into a wall outlet 72 and thereby being electrically connected to on-line power line 74.

Figure 5:
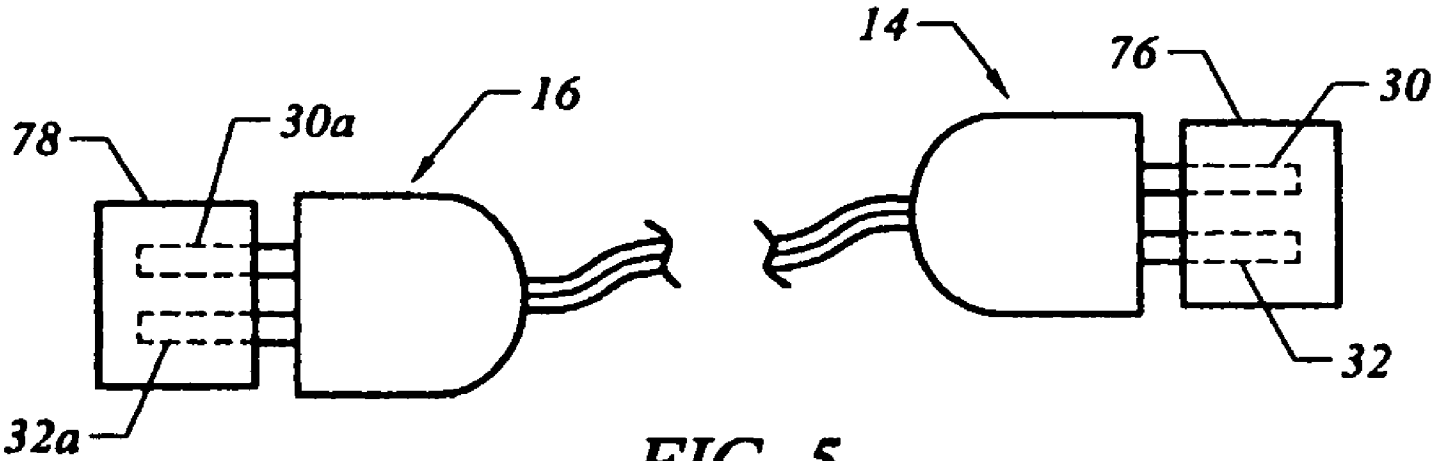

Referring to FIG. 5, first male plug 14 and second male plug 16 are shown with an insulative first safety cap 76 and an insulative second safety cap 78 respectively, in engaged positions. Safety caps 76, 78 are commercially available caps which prevent a standard male plug (such as first plug 14 or second plug 16) from being used. Safety caps 76, 78 are lockable so that a child will not be able to open it and yet it is readily opened by an adult. Safety caps 76, 78 are in other words reversibly lockable and easily removed.

When safety caps 76, 78 are engaged as shown, first plug 14 and second plug 16 are not insertable into a female electrical connection. Optionally, one of the safety caps 76, 78 may be omitted.

Figure 6:
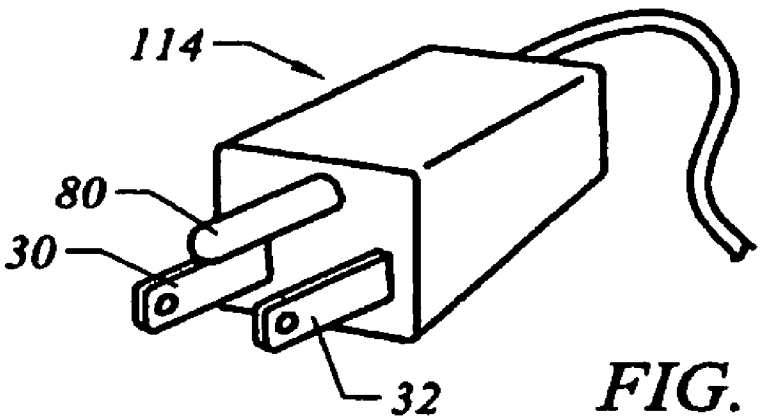
FIG. 6 is a three-prong male plug representative of the prior art.

Referring to FIG. 6, a male plug 114 is shown in accordance with the prior art. Male plug 114 has a first lead 30 and a second lead 32 in strictly analogous fashion with first male plug 14 of connector 10, but further includes a third grounding lead 80, and hence male plug 114 is not suitable for use with string 50 or other ungrounded decorative lights.

Referring again to FIG. 3, connector 10 is easily assembled in the following manner. Second lead 32 is moved into the engaged position in strictly symmetrical fashion with first lead 30, so that second peg 40 is received in substrate 34, piercing second channel 20 so as to be in electrical communication with second conductor 24. Then housing 42 is moved from right to left as viewed in FIG. 3 (relative to cord 12) so that substrate 34 and portions of first lead 30 and second lead 32 are snugly received in invagination 48 (see FIG. 4*a*) and "snapped-in." It should be noted that in the engaged position both first lead 30 and second lead 32 flare slightly to provide additional mechanical tension biasing in favor of the snapped-in position. Second plug 16 is likewise assembled to the snapped-in position in strictly analogous fashion relative to first plug 14.

Referring to FIG. 2*a,* the use of connector 10 will now be described in accordance with the present invention. When a user takes a string 50 of decorative lights 52 and begins to wrap it around an object to be decorated, such as a Christmas tree, doorframe, the outside of a house, a group of trees or other suitable structure, he may accidentally begin wrapping from male end 56 of string 50. At the end of the wrapping sequence (regardless of whether he also couples further strings 50 from female end 58 to male end 56 of the next string 50) he will ultimately discover his mistake when he is left with a loose female end 58. Previously, the user would be required to unwrap the lights and start again this time from female end 58.

First safety caps 76, 78 are removed if engaged. In accordance with the invention, the user is now able to take connector 10 and place the first male plug 14 into female end. The user then connects second plug 16 into female end 68 of extension cord 64 and then male end 70 of extension cord 64 will either go into outlet 72 as shown or will be repetitively connected to other extension cords as desired until the last extension cord is engaged with outlet 72 so that electrical power can be provided form on-line power line. In this fashion and in accordance with the invention, electrical power is provided to lights 52 without having to rewrap string 50.

Referring now to FIG. 7*a,* a particularly preferred embodiment of the invention will now be described. FIG. 7*a* depicts a jacket 832 to be used in conjunction with connector 10 of FIG. 1. Jacket 82 is normally constructed of a rugged insulative material such as PVC or another synthetic resin material. Jacket 82 includes a left half 84 and a right half 86 connected by a neck 88. The left half 84 includes a first end 90 and right half 86 includes a second end 92 as shown. First end 90 includes an externally threaded portion 94 and second end 92 includes an externally threaded portion 96. Jacket 82 is substantially hollow to form an interior passage 98 as shown (see FIG. 7*b*).

Referring to FIG. 7*b,* an electrical connector apparatus 83 in accordance with the invention is shown. Apparatus 83 includes jacket 82 and electrical connector 10 substantially disposed within interior channel 98 of jacket 82. In particularly preferred embodiments apparatus 83 includes a first threaded cover 110 and a second threaded cover 112 for reversible threaded engagement respectively with first end 90 and second end 92 with jacket 82 (see FIG. 7*d*). Further note second cover 112 is shown sectionally so as to expose an internally threaded portion 113 for mating engagement with threaded portion 96 of second end 92. In the particularly preferred variant of the invention utilizing jacket 82 and covers 110 and 112, caps 76, 78 (shown in FIG. 5) will be omitted because of the safety features of jacket 82 described below.

Referring to FIG. 7*c*, neck 88 includes a first neck stopping area 100 and a second neck stopping area 102 as shown. Connector 10 is received within jacket 82. Neck 88 presents a minimum diameter 104 as shown. First male plug 14 presents a first housing diameter 106 which is substantially transverse to the longitudinal direction of first lead 30 and second lead 32. Second male plug 16 presents a second housing diameter 108 as shown which is substantially transverse to the longitudinal direction of first lead 30*a* and second lead 32*a*. The diameter of first male housing 106 and the diameter of second male housing 108 are both greater than the diameter of the minimum diameter 104 of neck 88, for operational reasons described below.

In operation, electrical connector apparatus 83 is used as follows. First covers 110 and 112 are threadably removed respectively from first end 90 and second end 92 of jacket 82. Then electrical connector 10 is axially displaced to the leftmost position. FIG. 7*b* approximately shows this position but it should be noted that in the operation described above electrical connector 10 will be shifted a slightly greater distance to the left relative to jacket 82 so that second male plug 16 abuts neck stopping area 102 of jacket 82. In this fashion first male plug 14 emerges and is completely exposed outside of left half 84 of jacket 82. First lead 30 and second lead 32 are then inserted into an appropriate female receptor such as the female end 58 of light string 50. Once first male plug 14 has been electrically connected to female end 58 of light string 50, the electrical connector 10 is axially displaced to the right relative to jacket 82 so that first male plug 14 abuts neck stopping area 100 of jacket 82. At that time second male plug 16 will be exposed out of irght half 86 of jacket 82 in strictly analogous fashion to that of first male plug 14 as shown in FIG. 7*b*. At that point, first male plug 16 will be electrically connected to an appropriate female receptacle, such as the female end of a string of Christmas lights, the female end of an extension cord, etc., in accordance with the invention.

It will be readily appreciated that since the axial length of jacket 82 is approximately twice as long as cord 12 of connector 10 that first male plug 14 and second male plug 16 can never be simultaneously exposed. This will prevent either plug from being exposed in "hot condition" while the other is being engaged and will provide safety from inadvertent use by children or pets.

Although the invention has been particularly shown and described with reference to preferred embodiments thereof, it will be understood by those skilled in the relevant art that various changes in form and details may be made therein without departing from the spirit and scope of the invention as defined by the appended claims.

What is claimed is:

1. In combination a connector and a jacket wherein:

a) said connector includes an elongate electrically conductive cord joined to first and second electrical male plugs on opposite ends of the cord; the cord having a first length; each of said plugs having a cross section that is larger than the cross section of said cord; and b) said jacket is a hollow elongate tube having opposite first and second ends and a second length wherein said first length is approximately one half said second length; said jacket having an internal restrictive neck that is spaced from said tube first and second ends; said cord passes through said neck and said plugs are located on opposite sides of the restrictive neck; said neck having a cross section larger than said cord but smaller than said plugs, such that said cord slides freely within said neck and said plugs are prevented from passage through said neck so that said connector is captured within said jacket and the cord is sized such that both plugs cannot be simultaneously exposed; said neck being spaced from said tube opposite ends sufficiently to allow either of said plugs to fully enter said tube; whereby when said first male plug is outside said tube, said second male plug is fully located within said tube.

2. The combination of claim 1, said jacket formed of insulative synthetic resin material.

3. The combination of claim 1, wherein said jacket is substantially twice as long as the axial length of the electrical connector.

4. The combination as claimed in claim 1, wherein upon the first male electrical plug being disposed outside the first end of the tube, the second male plug abuts against the neck, and upon the second male electrical plug being disposed out side the second end of the tube, the first male plug abuts against the neck.

5. The combination of claim 1, wherein said first and second ends of the tube are externally threaded.

6. The combination of claim 5, including covers threadably secured to the externally threaded ends of said tube.

7. The combination according to claim 1 wherein:

a) said tube is constructed of a stiff polymeric resin.

8. The combination according to claim 7 wherein:

a) said stiff polymeric resin is PVC.

9. In an apparatus having a connector with dual male plugs wherein the connector has an electrical conduit with male electrical plugs at opposite ends of and electrically joined to the conduit and further wherein the connector has a first length; the improvement comprising:

a) a protective jacket positioned about the connector; said jacket having an elongate tube that has a second length that is approximately twice as long as said connector first length;

b) said tube having open first and second opposite ends; said tube having an interior restriction that is approximately equally spaced from said tube first and second ends; said restriction being sized and shaped to slidingly receive said conduit therethrough while being too narrow to allow passage of either of said plugs; said conduit being positioned through said restriction and said first and second plugs being positioned on opposite sides of said restriction such that said connector is captured within said jacket; said restriction being spaced from said tube ends at least sufficiently to allow both of said first and second plugs to alternatively fully enter said tube; whereby whenever the first of said plugs is extending from said tube, the second of said plugs is within said tube.

10. The apparatus according to claim 9 wherein:

a) said jacket is constructed of PVC.

* * * * *